US008528776B2

(12) United States Patent
Treacy

(10) Patent No.: US 8,528,776 B2
(45) Date of Patent: Sep. 10, 2013

(54) PAINT RIM MAGNETIC BRUSH HOLDER

(76) Inventor: Ronald Arthur Treacy, Haines City, FL (US)

( * ) Notice: Subject to any disclaimer, the term of this patent is extended or adjusted under 35 U.S.C. 154(b) by 70 days.

(21) Appl. No.: 13/150,483

(22) Filed: Jun. 1, 2011

(65) Prior Publication Data

US 2012/0187135 A1 Jul. 26, 2012

Related U.S. Application Data

(60) Provisional application No. 61/350,738, filed on Jun. 2, 2010.

(51) Int. Cl.
*B65D 90/00* (2006.01)

(52) U.S. Cl.
USPC ..... 220/697; 248/206.5; 211/DIG. 1

(58) Field of Classification Search
USPC ..... 220/697; 248/206.5, 213.2; 211/DIG. 1; 206/350
See application file for complete search history.

(56) References Cited

U.S. PATENT DOCUMENTS 5,033,704 A * 7/1991 Kerr ..... 248/110
D345,833 S * 4/1994 Truran ..... D32/54
D664,320 S * 7/2012 Sakko ..... D32/54

* cited by examiner

*Primary Examiner* — J. Gregory Pickett
*Assistant Examiner* — Raven Collins
(74) *Attorney, Agent, or Firm* — Sinorica, LLC

(57) ABSTRACT

The present invention is a paint rim magnetic brush holder, which is an annular attachment placed on an opened paint can. The paint rim magnetic brush holder uses a rim, extended past the lateral surface of the opened paint can, to prevent stray drops of paint from hitting the opened paint can. The present invention uses a magnet and a platform to provide a convenient place to rest a wet paint brush. The wet paint brush is positioned on the platform in such a way that the wet paint brush drips into the opened paint can. The wet paint brush is held in place on the platform with the magnet. The paint rim magnetic brush holder uses a paint pourer spout to easily pour the paint in the opened paint can into the another paint can.

12 Claims, 5 Drawing Sheets

PAINT RIM MAGNETIC BRUSH HOLDER

The current application claims a priority to the U.S. Provisional Patent application Ser. No. 61/350,738 filed on Jun. 2, 2010.

FIELD OF THE INVENTION

The present invention relates generally to an attachment for a paint can with the lid taken off. More particularly, the present invention provides a means to hold a paint brush, a means to prevent stray drops of paint from hitting the opened paint can, a means to smoothly pour the contents of the opened paint can into another paint can.

BACKGROUND OF THE INVENTION

Traditionally, pouring paint from a paint can is usually messy, which results in paint running down the lateral surface of the paint can and onto the floor, hands, and other inconvenient places. In addition, reattaching the lid to the paint can is difficult once the residual paint has dried on the mouth of the paint can. A user, painting with the paint can and a paint brush, may find it difficult set the paint brush down because the wet paint on the bristles of the paint brush may touch the floor, hands, or other inconvenient places. The paint rim magnetic brush holder is an annular attachment to the paint can that allows the user to both prevent stray paint drops from hitting the paint can, provides a convenient place to set the paint brush down, and situates the paint brush on the convenient place with a magnet. The present invention also has a pouring spout, which allows the user to easily pour the paint in the paint can into another paint can.

DETAIL DESCRIPTIONS OF THE INVENTION

All illustrations of the drawings are for the purpose of describing selected versions of the present invention and are not intended to limit the scope of the present invention.

Figure 1:
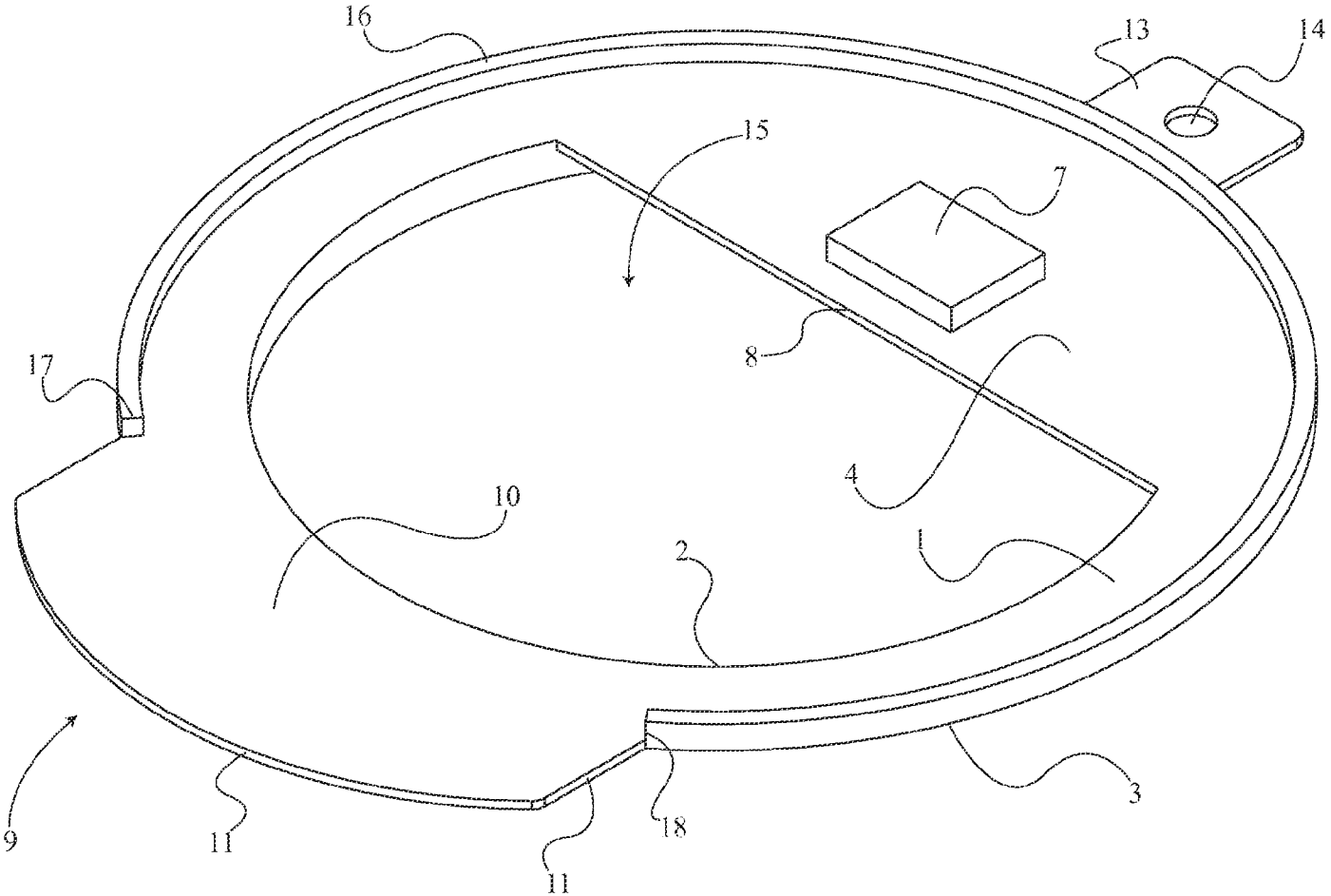
FIG. 1 is a perspective view of the present invention.
Figure 3:
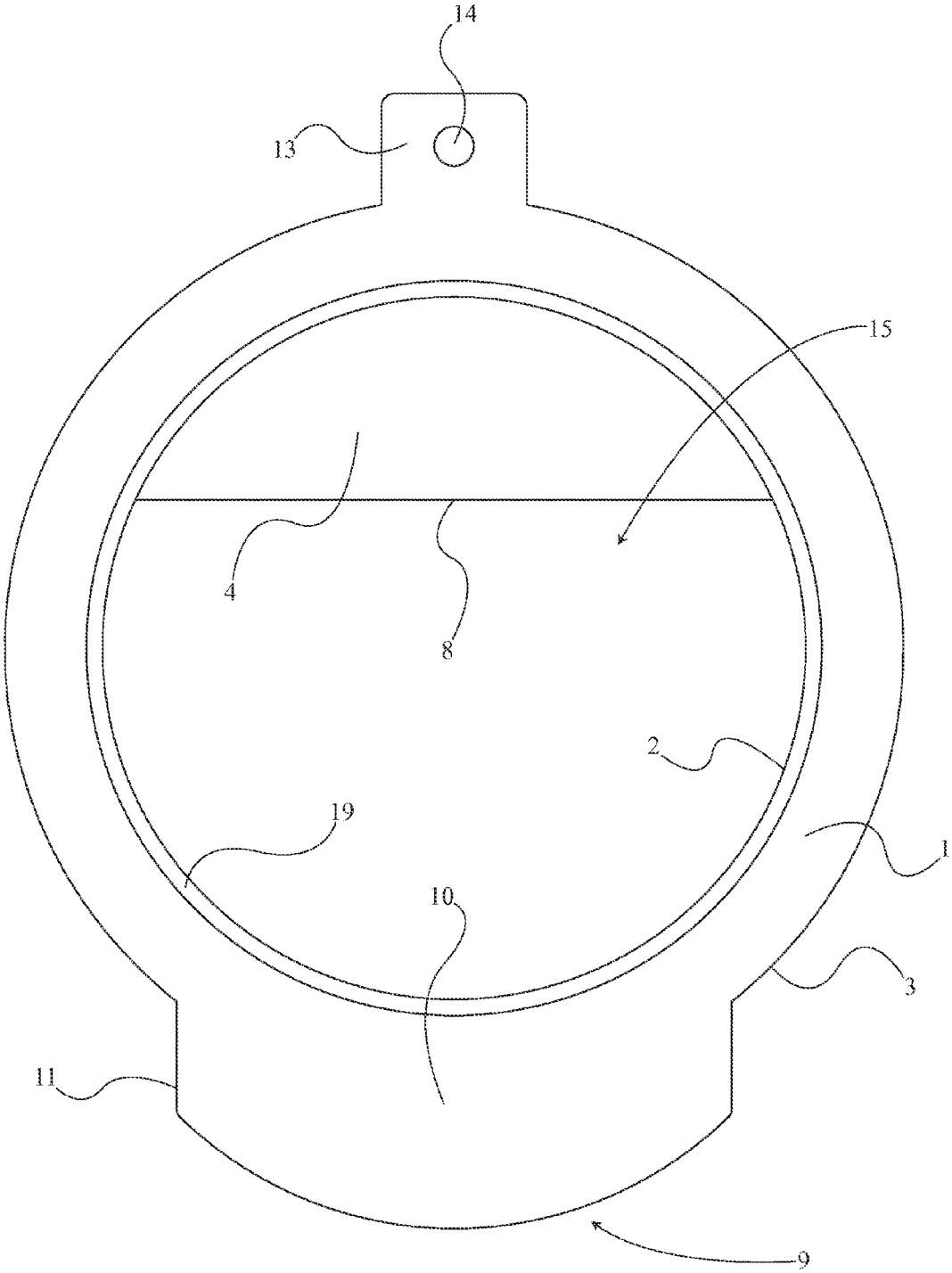
FIG. 3 is a bottom view of the present invention.
Figure 4:
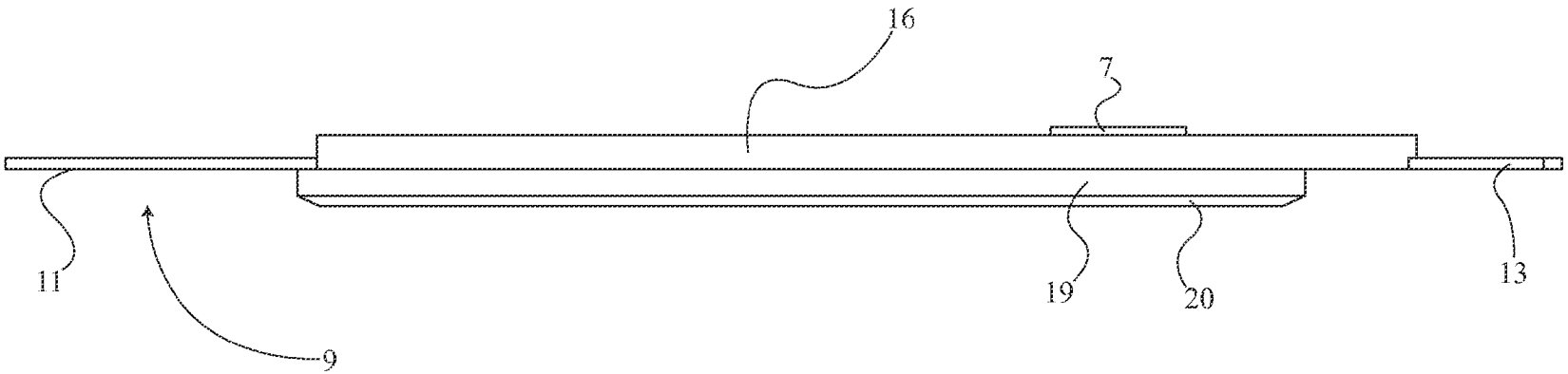
FIG. 4 is a side view of the present invention.

The present invention as shown in FIG. 1 is a paint rim magnetic brush holder, which a user attaches to an opened paint can to perform a variety of functions. The paint rim magnetic brush holder comprises a rim 1, a platform 4, a paint spout pourer 9, a tab 13, an opening 15, a wall 16, and a fitting 19. The rim 1 is an annular object having an inner edge 2 and an outer edge 3 and is relatively flat along its radius. The rim 1 serves as a base for all other components of the present invention to be connected together. The fitting 19 is a tube with the same radius as the inner edge 2 and is connected to the bottom of the rim 1 along the inner edge 2 as illustrated in FIG. 3. The fitting 19 engages and attaches the present invention to the opened paint can by sliding into the mouth of the opened paint can. The fitting 19 has an angled bottom surface 20 displayed in FIG. 4, which allows the user to better situate the present invention onto the mouth of the opened paint can before pressing the fitting 19 into the mouth. The tab 13 connects to the outer edge 3 and is located on the same plane as the rim 1. A tab hole 14 is located at the center of the tab 13, and, together, the tab 13 and tab hole 14 allow the user to hang up the present invention when the present invention is not being used.

The first function of the present invention is to prevent paint from dripping onto the onto the opened paint can. The components used to accomplish the first function include the rim 1 and the wall 16. The outer edge 3 of the rim 1 has a larger radius than the radius of the opened paint can so that the rim 1 extends out over the lateral surface of the opened paint can. The rim 1 catches stray paint drops from a paint brush dipped into the opened paint can and prevents the stray paint drops from hitting the lateral surface of the opened paint can. The rim 1 also prevents the strap paint drops from hitting the mouth of the opened paint can. The wall 16, which is a perpendicular protrusion attached around the outer edge 3 and on top of the rim 1. Once the stray paint drops hit the rim 1, the wall 16 prevents the stray paint drops from rolling over the outer edge 3 and onto the lateral surface of the opened paint can. The wall 16 comprises a first end 17 and a second end 18 because the paint spout pourer 9 radially extends out of a portion of the outer edge 3, and thus, the wall 16 connects to one side of paint spout pourer 9 with the first end 17 and connects to the other side of the paint spout pourer 9 with the second end 18.

Figure 2:
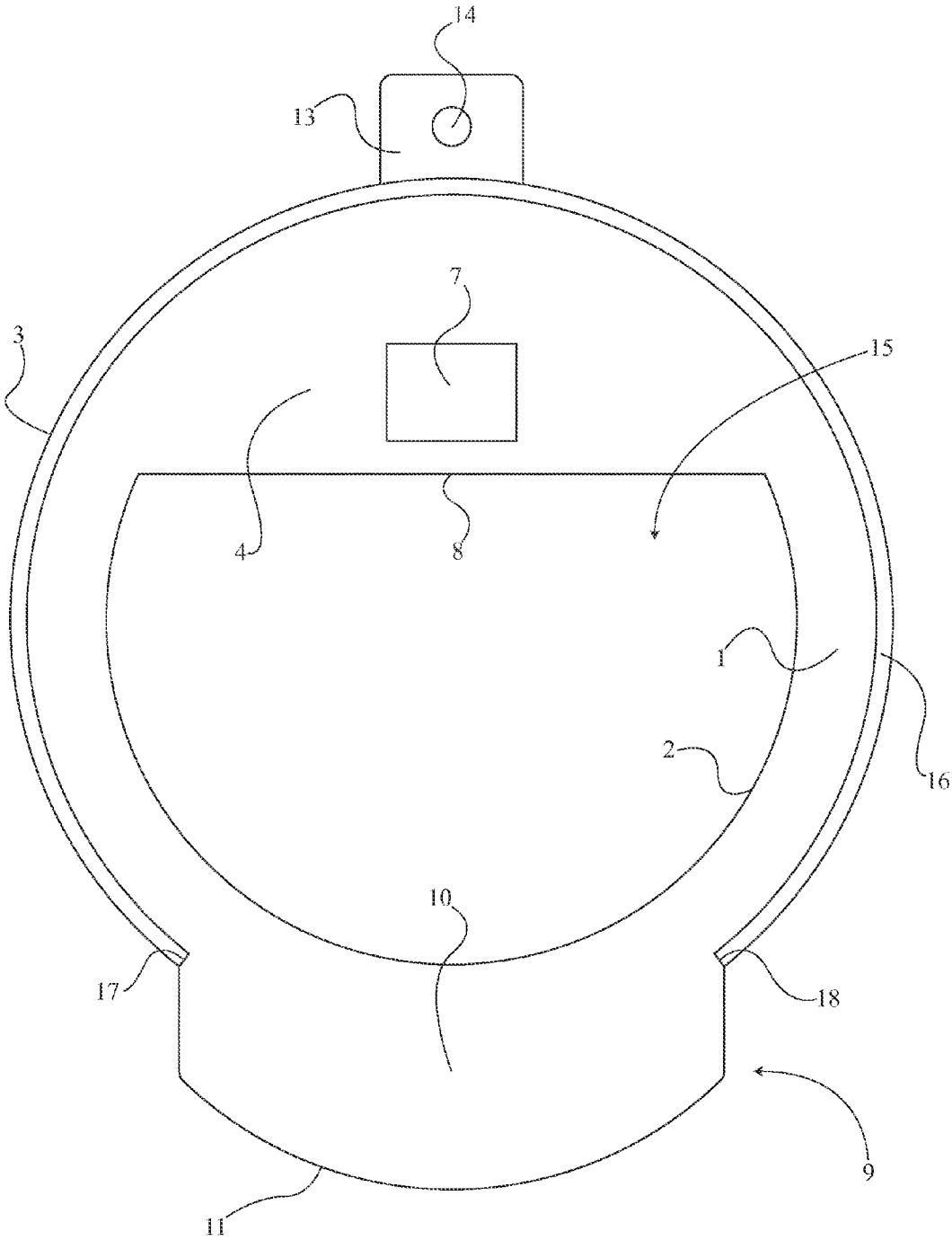
FIG. 2 is a top view of present invention.
Figure 5:
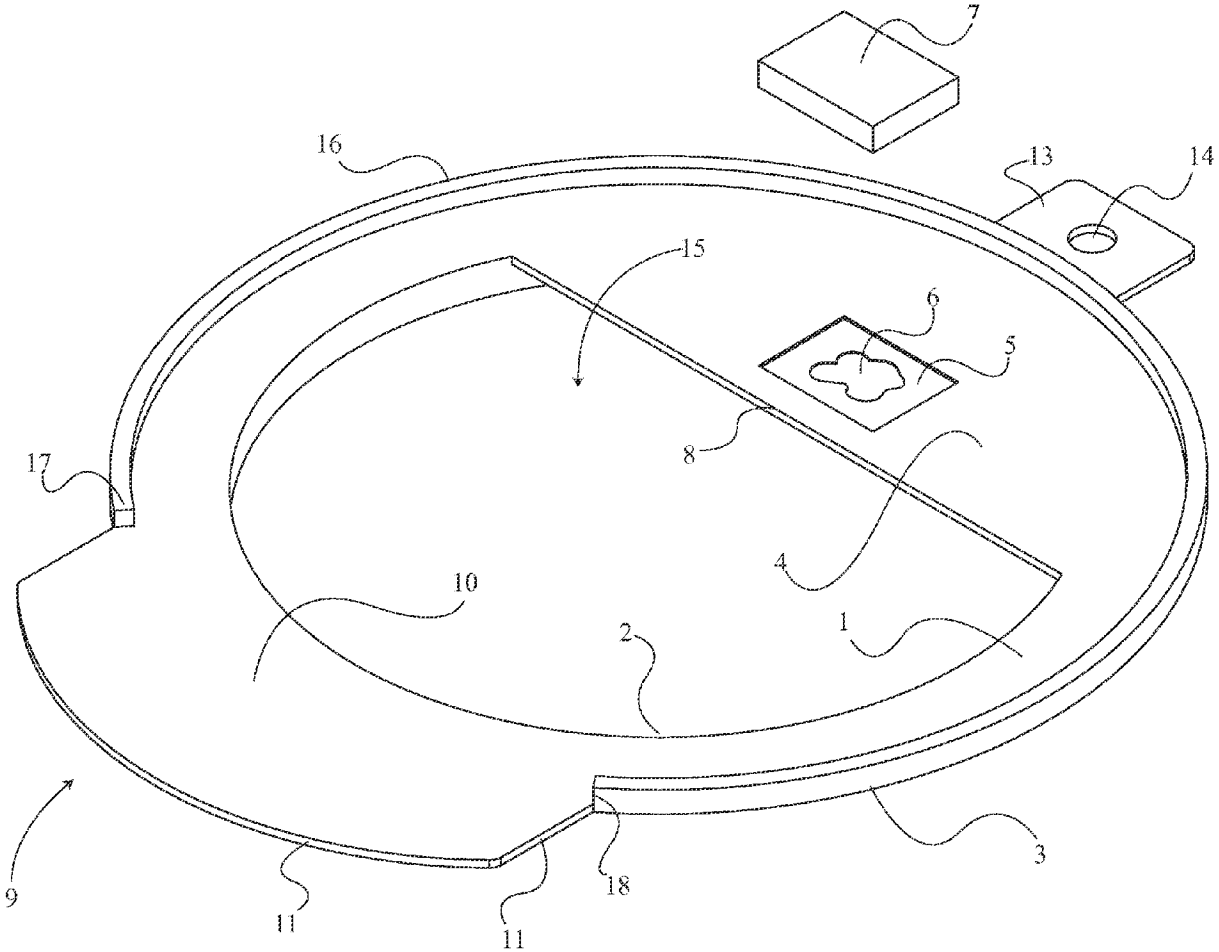
FIG. 5 is a perspective view of the present invention with the magnet separated from the rest of the present invention.

The second function of the present invention is to provide a convenient area to place the paint brush while not being used. The components used to accomplish the second function include the platform 4 and the opening 15. As shown in FIG. 2, the platform 4 is a semicircular plate attached to a portion of the inner edge 2 and is located on the same plane as the rim 1. The platform 4 provides the user with the convenient area to place the paint brush. The platform 4 comprises a cut away 5, an adhesive 6, a magnet 7, and a brush wipe edge 8. The cut away 5 is an indentation located in middle of the platform 4, which is shaped to properly situate the magnet 7 on the platform 4. The magnet 7 is attached to the platform 4 by the adhesive 6, which can be seen in FIG. 5. If the platform 4 is made of a metal, then the magnet 7 will also attach to the cut away 5 by a magnetic force. The brush wipe edge 8 is the straight edge of the platform 4 that does not connect to the inner edge 2. The brush wipe edge 8 and the portion of the inner edge 2 not connected to the platform 4 form the outline of the opening 15, which leads into the opened paint can. In order to prevent a mess, the paint brush is placed on the platform 4 in such a position that the bristles of paint brush soaked in paint can drip into the opening 15 and, thus, into the paint can. In this position, the paint brush is unbalanced on the platform 4 and may tip into the opened paint can through the opening 15. The magnet 7 attracts and attaches the metal portion of the paint brush, which allows the present invention to situate and stabilize the paint brush on the platform 4. The metal portion of the paint brush is usually the anchor or staple that holds the bristles of the paint brush together.

The third function of the present invention is to allow the user to wipe the excess paint off of the bristles of the paint brush once the paint brush is dipped into the opened paint can. The components used to accomplish the third function include the brush wipe edge 8 and the opening 15. The brush wipe edge 8 allows the user to apply a constant force to each of bristles on the paint brush so that the excess paint on the paint brush is evenly scraped off the bristles. The brush wipe edge 8 also outlines the opening 15 so that once the excess paint is scraped off the bristles of the paint brush with the brush wipe edge 8, the excess paint can fall through the opening 15 into the opened paint can.

The fourth function of the present invention to allow the user to pour the paint in the opened paint can into another paint can without creating a mess. The component used to accomplish the fourth function includes the paint spout pourer 9. After the paint exits the opened paint can through the opening 15, the paint spout pourer 9 guides the paint pouring into the other paint can. The paint spout pourer 9 comprises a spout plate 10 and a protruding edge 11. The spout plate 10 is a panel that is coplanar with the rim 1 and is connected to the portion of the outer edge 3 unoccupied by the wall 16. The protruding edge 11 is the edge of the spout plate 10 that extends further from the rim 1 than the outer edge 3. When emptying the paint out the opened paint can, the paint pours out of the opening 15 and flows onto the rim 1. The first end 17 and the second end 18 streamlines and narrows the flow of paint as the flow of paint moves from the rim 1 onto the spout plate 10, which allows the user to easily guide the flow of paint into the other paint can. The spout plate 10 extends the flow of paint further out than the outer edge 3 and prevents the flow of paint from touching the lateral surface of the opened paint can when the flow of paint goes over the protruding edge 11.

Although the invention has been explained in relation to its preferred embodiment, it is to be understood that many other possible modifications and variations can be made without departing from the spirit and scope of the invention as hereinafter claimed.

What is claimed is:

1. A paint rim magnetic brush holder comprises,
a rim;
a platform;
a paint spout pourer;
a tab;
an opening;
a wall;
a fitting;
said rim having an inner edge and an outer edge;
said platform comprises a cut away, an adhesive, a magnet, and a brush wipe edge;
said paint spout pourer comprises a spout plate and a protruding edge;
said tab comprises a tab hole;
said wall having a first end and a second end;
said fitting having an angled bottom surface;
said cut away being centrally positioned on said platform;
said cut away being positioned atop said platform;
said magnet being positioned into said cut away;
said magnet being attached to said cut away with said adhesive;
said brush edge being adjacent to said magnet;
said opening being shaped by said inner edge and said brush wipe edge;
said fitting being connected below said rim along said inner edge;
said fitting being perpendicularly positioned to said rim; and
said angled bottom surface being positioned opposite of said rim on said fitting;
said platform being coplanar with said rim
said tab being coplanar with said rim
said spout plate being coplanar with said rim.

2. The paint rim magnetic brush holder as claimed in claim 1 comprises,
said platform being coplanar with said rim; and
said platform being connected to said rim along said inner edge.

3. The paint rim magnetic brush holder as claimed in claim 1 comprises,
said tab being connected to said rim along said outer edge;
said paint spout pourer being connected to said rim along said outer edge; and
said tab being diametrically opposed to said paint spout pourer along said rim.

4. The paint rim magnetic brush holder as claimed in claim 3 comprises,
said tab being coplanar with said rim; and
said tab hole being centrally positioned on said tab.

5. The paint rim magnetic brush holder as claimed in claim 3 comprises,
said spout plate being coplanar with said rim;
said spout plate being connected to said rim along said outer edge; and
said protruding edge being shaped by said spout plate protruding out of said rim.

6. The paint rim magnetic brush holder as claimed in claim 1 comprises,
said wall being connected atop said rim along said outer edge;
said wall being perpendicularly positioned to said rim;
said first end being located adjacent to said paint spout pourer; and
said second end being located adjacent to said paint spout pourer opposite said first end.

7. A paint rim magnetic brush holder comprises,
a rim;
a platform;
a paint spout pourer;
a tab;
an opening;
a wall;
a fitting;
said rim having an inner edge and an outer edge;
said platform comprises a cut away, an adhesive, a magnet, and a brush wipe edge;
said paint spout pourer comprises a spout plate and a protruding edge;
said tab comprises a tab hole;
said wall having a first end and a second end;
said fitting having an angled bottom surface;
said cut away being centrally positioned on said platform;
said cut away being positioned atop said platform;
said magnet being positioned into said cut away;
said magnet being attached to said cut away with said adhesive;
said brush edge being adjacent to said magnet;
said opening being shaped by said inner edge and said brush wipe edge;
said fitting being connected below said rim along said inner edge;
said fitting being perpendicularly positioned to said rim;
said angled bottom surface being positioned opposite of said rim on said fitting;
said tab being connected to said rim along said outer edge;
said paint spout pourer being connected to said rim along said outer edge;
said tab being diametrically opposed to said paint spout pourer along said rim;
said wall being connected atop said rim along said outer edge; and
said wall being perpendicularly positioned to said rim;
said platform being coplanar with said rim
said tab being coplanar with said rim
said spout plate being coplanar with said rim.

8. The paint rim magnetic brush holder as claimed in claim 7 comprises,
said platform being coplanar with said rim; and said platform being connected to said rim along said inner edge.

9. The paint rim magnetic brush holder as claimed in claim 7 comprises, said tab being coplanar with said rim; and said tab hole being centrally positioned on said tab.

10. The paint rim magnetic brush holder as claimed in claim 7 comprises, said spout plate being coplanar with said rim;

said spout plate being connected to said rim along said outer edge; and said protruding edge being shaped by said spout plate protruding out of said rim.

11. The paint rim magnetic brush holder as claimed in claim 7 comprises, said first end being located adjacent to said paint spout pourer; and said second end being located adjacent to said paint spout pourer opposite said first end.

12. A paint rim magnetic brush holder comprises, a rim;

a platform;

a paint spout pourer;

a tab;

an opening;

a wall;

a fitting;

said rim having an inner edge and an outer edge;

said platform comprises a cut away, an adhesive, a magnet, and a brush wipe edge;

said paint spout pourer comprises a spout plate and a protruding edge;

said tab comprises a tab hole;

said wall having a first end and a second end;

said fitting having an angled bottom surface;

said platform being coplanar with said rim;

said platform being connected to said rim along said inner edge;

said cut away being centrally positioned on said platform;

said cut away being positioned atop said platform;

said magnet being positioned into said cut away;

said magnet being attached to said cut away with said adhesive;

said brush edge being adjacent to said magnet;

said opening being shaped by said inner edge and said brush wipe edge;

said fitting being connected below said rim along said inner edge;

said fitting being perpendicularly positioned to said rim;

said angled bottom surface being positioned opposite of said rim on said fitting;

said tab being connected to said rim along said outer edge;

said paint spout pourer being connected to said rim along said outer edge;

said tab being diametrically opposed to said paint spout pourer along said rim;

said wall being connected atop said rim along said outer edge;

said wall being perpendicularly positioned to said rim;

said first end being located adjacent to said paint spout pourer;

said second end being located adjacent to said paint spout pourer opposite said first end;

said tab being coplanar with said rim;

said tab hole being centrally positioned on said tab;

said spout plate being coplanar with said rim;

said spout plate being connected to said rim along said outer edge; and said protruding edge being shaped by said spout plate protruding out of said rim.

* * * * *